US007843475B2

(12) United States Patent
Yamade et al.

(10) Patent No.: US 7,843,475 B2
(45) Date of Patent: Nov. 30, 2010

(54) THERMAL PRINT HEAD AND METHOD FOR MANUFACTURING THE SAME

(75) Inventors: Takumi Yamade, Kyoto (JP); Masatoshi Nakanishi, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 113 days.

(21) Appl. No.: 12/438,859

(22) PCT Filed: Aug. 27, 2007

(86) PCT No.: PCT/JP2007/066529

§ 371 (c)(1),
(2), (4) Date: Feb. 25, 2009

(87) PCT Pub. No.: WO2008/026533

PCT Pub. Date: Mar. 6, 2008

(65) Prior Publication Data

US 2009/0201356 A1 Aug. 13, 2009

(30) Foreign Application Priority Data

Aug. 28, 2006 (JP) ..... 2006-230495

(51) Int. Cl.
*B41J 2/335* (2006.01)

(52) U.S. Cl. ..... 347/200

(58) Field of Classification Search ..... 347/200, 347/202, 208, 207

See application file for complete search history.

(56) References Cited

U.S. PATENT DOCUMENTS

| | | | |
|---|---|---|---|
| 5,252,988 | A | 10/1993 | Katayama et al. |
| 5,661,513 | A | 8/1997 | Shirakawa et al. |
| 6,184,913 | B1 | 2/2001 | Nagano et al. |
| 7,212,222 | B2 | 5/2007 | Yamakawa |
| 2007/0229645 | A1 | 10/2007 | Yamamoto et al. |

FOREIGN PATENT DOCUMENTS

| | | |
|---|---|---|
| EP | 0 391 717 | 10/1990 |
| JP | 60-193667 | 10/1982 |
| JP | 62-46657 | 2/1987 |
| JP | 62-169665 | 7/1987 |
| JP | 62-299348 | 12/1987 |
| JP | 2-204057 | 8/1990 |
| JP | 4-16360 | 1/1992 |
| JP | 4-319446 | 11/1992 |

(Continued)

*Primary Examiner*—Huan H Tran
(74) *Attorney, Agent, or Firm*—Hamre, Schumann, Mueller & Larson, P.C.

(57) ABSTRACT

A thermal printhead (A1) includes an insulating substrate (1), a glaze (2), a plurality of pairs of first and second electrodes (3A, 3B) and heating resistors (5). Each of the heating resistors (5) includes a heating portion (5*a*) spaced apart from the first electrode (3A) and the second electrode (3B). The respective ends (31A, 31B) of the electrodes (3A, 3B) are embedded in the glaze (2). An insulating film (4) is provided between the heating portion (5*a*) of each heating resistor (5) and the glaze (2). The hardness of the insulating film (4) is higher than that of the glaze (2) and lower than that of the heating resistor (5). The thermal conductivity of the insulating film (4) is higher than that of the glaze (2) and lower than that of the heating resistor (5).

4 Claims, 5 Drawing Sheets

FOREIGN PATENT DOCUMENTS

| | | |
|---|---|---|
| JP | 4-347662 | 12/1992 |
| JP | 5-77462 | 3/1993 |
| JP | 5-131665 | 5/1993 |
| JP | 8-39853 | 2/1996 |
| JP | 8-207333 | 8/1996 |
| JP | 8-207334 | 8/1996 |
| JP | 9-123504 | 5/1997 |
| JP | 11-34374 | 2/1999 |
| JP | 2001-246770 | 9/2001 |
| JP | 2005-47060 | 2/2005 |
| JP | 2005-254506 | 9/2005 |
| WO | WO 2005-120841 | 12/2005 |

THERMAL PRINT HEAD AND METHOD FOR MANUFACTURING THE SAME

TECHNICAL FIELD

The present invention relates to a thermal printhead for performing printing on a recording medium such as a thermal paper. The present invention also relates to a method for manufacturing a thermal printhead.

BACKGROUND ART

FIG. 9 shows an example of conventional thermal printhead. In the thermal printhead X shown in the figure, a heating resistor 93, electrodes 94A, 94B and a protective film 95 are laminated on a substrate 91 formed with a glaze 92. The portion of the heating resistor 93 which is sandwiched between the electrodes 94A and 94B serves as a heating portion 93*a*. The glaze 92 is made of e.g. glass and bulges in the thickness direction of the substrate 91 in cross section. The glaze 92 has a relatively low thermal conductivity and prevents the heat from the heating portion 93*a* from unduly escaping to the substrate 91.

In the thermal printhead X, the heating portion 93*a* is located at a position retreated from a recording medium relative to the electrodes 94A and 94B. A structure like this is also disclosed in FIG. 1 of Patent Document 1 identified below. With this structure, however, of the protective film 95, the portion covering the heating portion 93*a* is pressed against a recording medium with a relatively small pressure, which hinders an increase in the printing speed.

Moreover, as the printing speed increases, the heating cycle of the heating portion 93*a* shortens. Since the heating portion 93*a* is directly formed on the glaze 92, the cycle in which the glaze 92 receives heat also shortens. Thus, during the printing operation by the thermal printhead X, the glaze 92 is kept at a relatively high temperature while repeating temperature rise and temperature drop. As a result, excessive thermal stress is applied on the glaze 92, which may cause cracking of the glaze 92.

Patent Document 1: JP-A-2001-246770

DISCLOSURE OF THE INVENTION

The present invention has been proposed under the circumstances described above. It is, therefore, an object of the present invention to provide a thermal printhead which is capable of increasing the printing speed.

According to a first aspect of the present invention, there is provided a thermal printhead comprising a substrate, a glaze formed on the substrate and extending in the primary scanning direction, a first and a second electrodes overlapping the glaze and spaced from each other in the secondary scanning direction, a heating resistor overlapping the first and the second electrodes and including a heat generating portion spaced apart from the electrodes, and an insulating film intervening between at least part of the heating portion of the heating resistor and the glaze. At least an end of each of the electrodes is embedded in the glaze. The insulating film has a hardness which is higher than the hardness of the glaze and lower than the hardness of the heating resistor and a thermal conductivity which is higher than the thermal conductivity of the glaze and lower than the thermal conductivity of the heating resistor.

With this structure, the level difference between each of the electrodes and the glaze is reduced. Further, owing to the existence of the insulating film, the heating portion is positioned close to a recording medium. As a result, the portion of the protective film which covers the heating portion is pressed against a recording medium with a high pressure. Thus, the printing speed can be increased. Moreover, the heat from the heating portion is transferred to the glaze via the insulating film. Thus, the amount of heat which the glaze receives is prevented from suddenly increasing or decreasing. As a result, the thermal stress generated in the glaze reduces, whereby the glaze is prevented from cracking. Further, the insulating film functions as a buffer between the glaze and the heating resistor. Thus, the thermal expansion or contraction of the glaze is prevented from being suppressed or promoted by the heating resistor. This is suitable for preventing the glaze from cracking.

Preferably, the insulating film is formed to bridge the first and the second electrodes. With this arrangement, the region of the glaze which is positioned between the first and the second electrodes is completely covered. Thus, the heating resistor and the glaze do not come into contact with each other at all, which is preferable for preventing the glaze from cracking.

Preferably, the insulating film is made of either one of $Ta_2O_5$ and $SiO_2$. This arrangement is suitable for achieving the above-described hardness and thermal conductivity of the insulating film.

According to a second aspect of the present invention, there is provided a method for manufacturing a thermal printhead. The method comprises the steps of forming a glaze extending in the primary scanning direction on a substrate and forming a first and a second electrodes spaced from each other in the secondary scanning direction on the glaze, sinking at least an end of each of the electrodes into the glaze by softening at least part of the glaze by heating, forming an insulating film to cover at least part of a region of the glaze which is sandwiched between the first and the second electrodes, and forming a heating resistor to overlap the glaze and the first and the second electrodes in such a manner as to bridge the first and the second electrodes. The insulating film is formed to have a hardness which is higher than the hardness of the glaze and lower than the hardness of the heating resistor and a thermal conductivity which is higher than the thermal conductivity of the glaze and lower than the thermal conductivity of the heating resistor. With this method, the level difference between each of the electrodes and the glaze is easily reduced. Further, owing to the existence of the insulating film, the heating portion is positioned close to a recording medium. As a result, the printing speed can be increased. Moreover, the insulating film suppresses the temperature variation in the glaze and prevents the thermal expansion or contraction of the glaze from being suppressed or promoted by the heating resistor. Thus, the glaze is prevented from cracking.

Other features and advantages of the present invention will become more apparent from the detailed description given below with reference to the accompanying drawings.

BEST MODE FOR CARRYING OUT THE INVENTION

Figure 1:
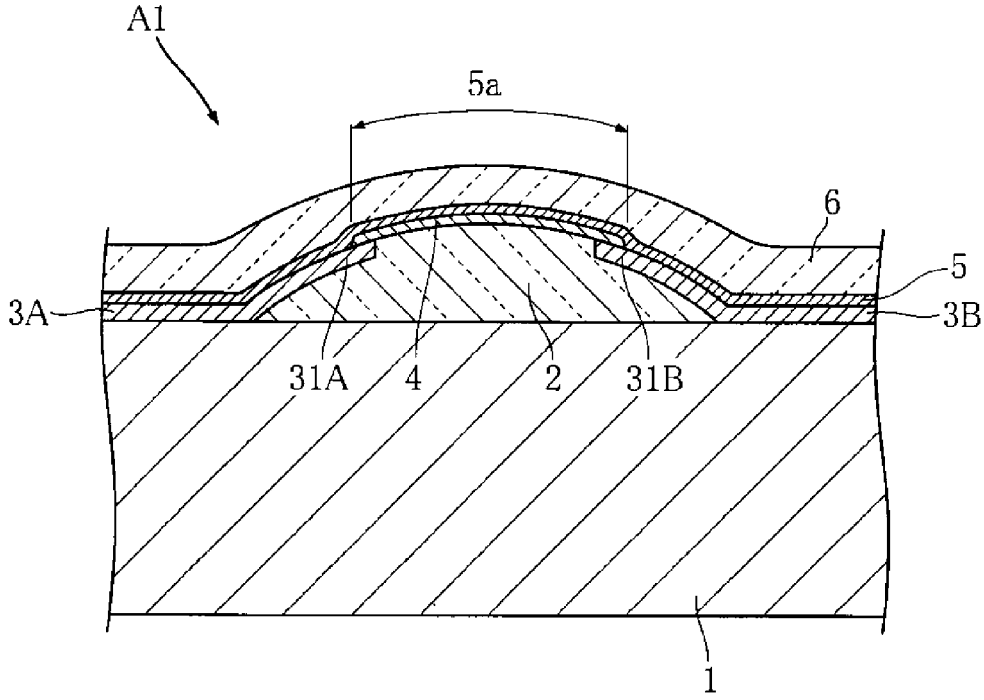
FIG. 1 is a sectional view showing a principal portion of a thermal printhead according to a first embodiment of the present invention.
Figure 2:
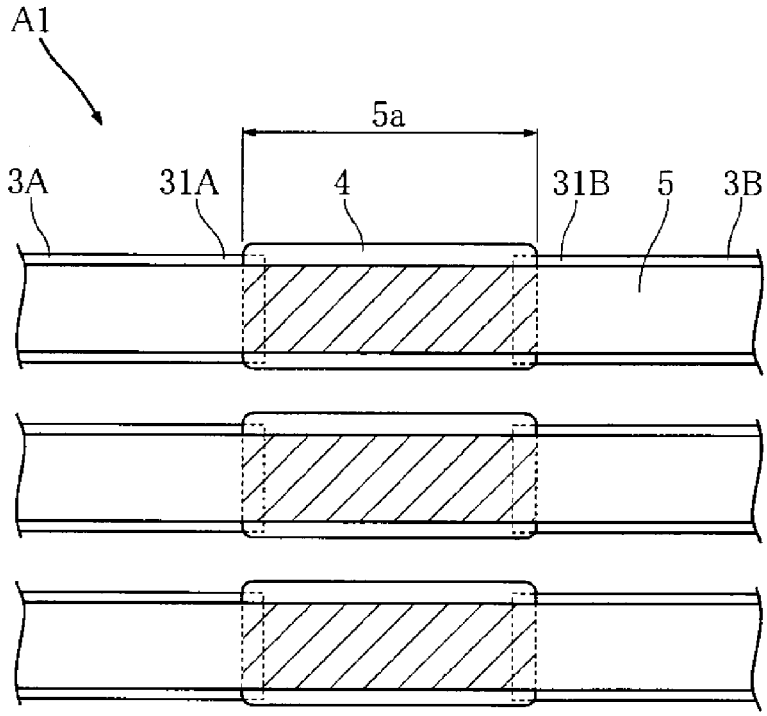
FIG. 2 is a plan view showing a principal portion of the thermal printhead according to the first embodiment.

Preferred embodiments of the present invention will be described below with reference to the accompanying drawings. FIGS. 1 and 2 show a thermal printhead according to a first embodiment of the present invention. The illustrated thermal printhead A1 includes a substrate 1, a glaze 2, a plurality of first electrodes 3A, a plurality of second electrodes 3B, insulating films 4, heating resistors 5 and a protective film 6. For easier understanding, only the electrodes 3A, 3B, the insulating films 4 and the heating resistors 5 are shown in FIG. 2.

The substrate 1 is a flat insulating plate which is in the form of an elongated rectangle extending in the primary scanning direction as viewed in plan and made of e.g. alumina ceramic material. The glaze 2 is formed on the substrate 1 by printing and baking amorphous glass paste, for example. The glaze 2 serves to retain heat and provide a smooth surface on which the electrodes 3A and 3B are to be formed. The glaze 2 is elongated in the primary scanning direction and bulges in the thickness direction of the substrate 1 in cross section. Due to this shape, the glaze 2 enhances the contact pressure between a recording medium such as thermal paper and the portion of the protective film 6 which covers the heating portion 5*a*, which will be described later. The maximum thickness of the glaze 2 is about 50 μm.

The first and the second electrodes 3A and 3B are formed in pairs on the substrate 1 and the glaze 2 by e.g. printing and baking gold resinate paste. As shown in FIG. 2, the first electrode 3A and the second electrode 3B of each pair are spaced from each other in the secondary scanning direction, with respective ends 31A and 31B facing each other. As shown in FIG. 1, the ends 31A and 31B are embedded in the glaze 2, and the upper surfaces of the ends 31A, 31B and the upper surface of the glaze 2 (the surface which is not covered with the ends 31A, 31B) forms a smooth curved surface free from a stepped portion. The electrodes 3A and 3B have a thickness of about 0.6 μm.

The insulating films 4 are made of e.g. $Ta_2O_5$ and formed by baking Ta films formed by sputtering, for example. The insulating films 4 cover the regions of the glaze 2 which are sandwiched between the paired electrodes 3A and 3B. In this embodiment, each of the insulating films 4 partially overlaps the ends 31A and 31B of the paired electrodes. That is, each insulating film 4 extends in such a manner as to bridge the paired electrodes 3A and 3B. The insulating film 4 has a thickness of about 0.1 to 0.2 μm. The hardness of the insulating film 4 is higher than that of the glaze 2 and lower than that of the heating resistors 5. The thermal conductivity of the insulating film 4 is higher than that of the glaze 2 and lower than that of the heating resistors 5. The insulating film 4 may be made of $SiO_2$ instead of $Ta_2O_5$.

The heating resistors 5 are formed on the insulating films 4 in such a manner as to bridge the electrodes 3A and 3B. The heating resistors 5 are made of e.g. $TaSiO_2$. Of each heating resistor 5, the portion which is not in direct contact with the electrodes 3A and 3B provides a heating portion 5*a* (see the diagonally shaded portion in FIG. 2). When a voltage is applied across the electrodes 3A and 3B, the heating portion 5*a* generates heat. By utilizing this heat, the thermal printhead A1 performs printing on a recording medium such as thermal paper. In this embodiment, as shown in FIG. 2, the width of the heating resistor 5 is smaller than that of the insulating film 4. The heating resistor 5 has a thickness of 0.05 μm.

The protective film 6 covers the glaze 2, the electrodes 3A, 3B, the insulating films 4 and the heating resistors 5. The protective film 6 is formed by e.g. sputtering using SiC or SiAlON. The protective film 6 prevents the electrodes 3A, 3B and the heating resistors 5 from coming into direct contact with a recording medium or being affected chemically or electrically. The protective film 6 also serves to provide a smooth surface. The thickness of the protective film 6 is about 4.0 μm.

A method for manufacturing the thermal printhead A1 will be described below with reference to FIGS. 3-6.

Figure 3:
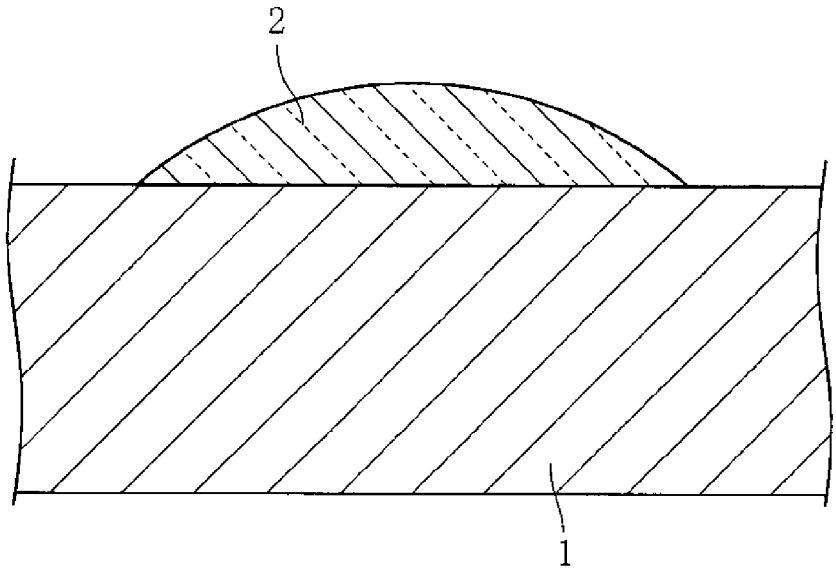
FIG. 3 is a sectional view showing the step of forming a glaze on a substrate in a method for manufacturing the thermal printhead according to the first embodiment.

First, as shown in FIG. 3, a glaze 2 is formed on a substrate 1. This is performed by printing and baking amorphous glass paste. Specifically, on the substrate 1, glass paste is first printed in the form of a strip extending in the primary scanning direction. Then, the glass paste is baked. As a result, a glaze 2 is obtained which has a maximum thickness of about 50 μm and bulges in the thickness direction of the substrate 1 in cross section.

Figure 4:
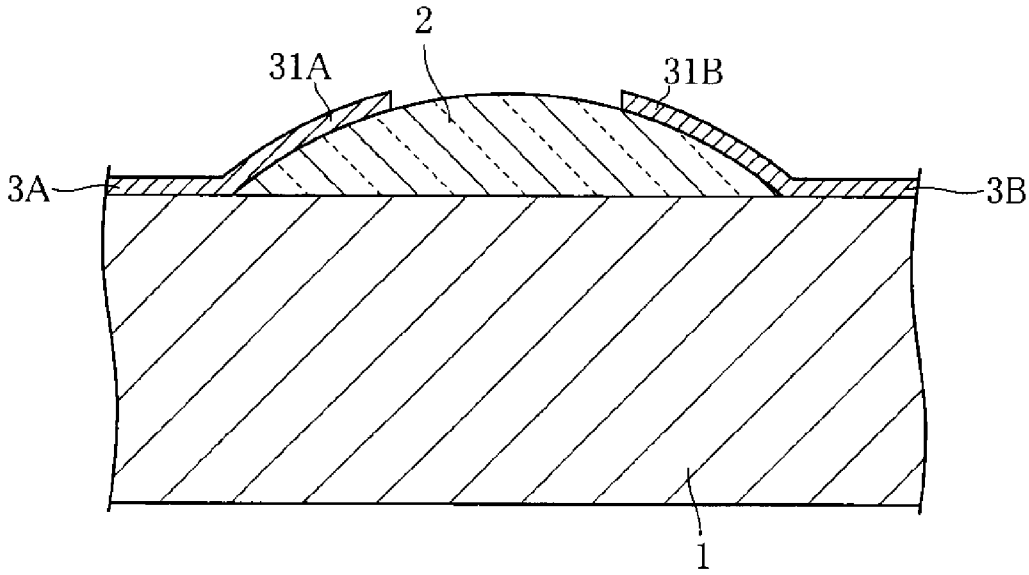
FIG. 4 is a sectional view showing the step of forming electrodes in the method for manufacturing the thermal printhead according to the first embodiment of the present invention.

Then, as shown in FIG. 4, electrodes 3A and 3B are formed on the upper surfaces of the substrate 1 and glaze 2. Specifically, first, gold resinate paste is printed in the form of a film on the upper surfaces of the substrate 1 and glaze 2, and then, the film is baked. Then, the baked paste film is subjected to patterning, whereby electrodes 3A and 3B are obtained. The amount of gold resinate paste to be applied and so on is so set in advance that the electrodes 3A and 3B have a thickness of about 0.6 μm.

Figure 5:
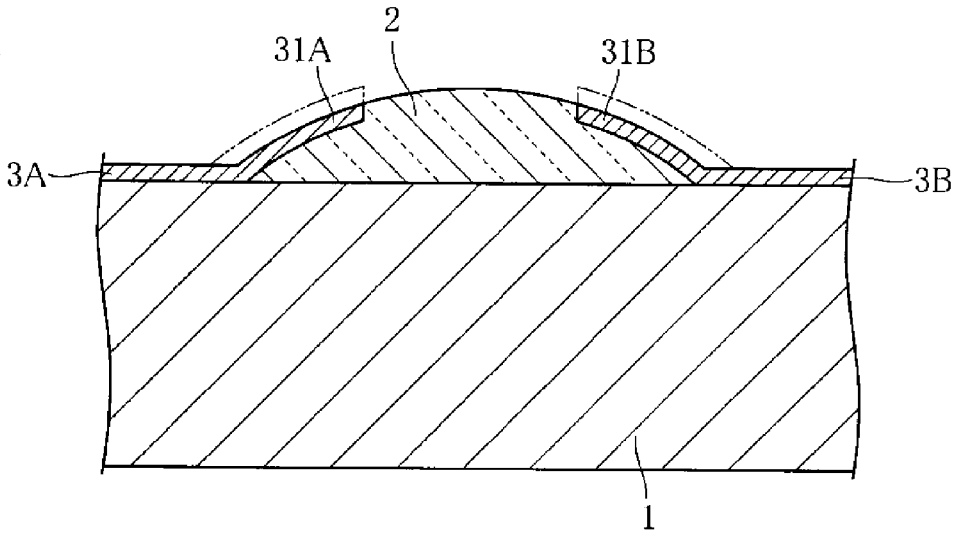
FIG. 5 is a sectional view showing the step of sinking the electrodes in the manufacturing method.

As shown in FIG. 5, after the electrodes 3A and 3B are formed, the ends 31A and 31B of the electrodes 3A and 3B are sunk into the glaze 2. This process can be achieved by softening the glaze 2 by heating. Specifically, the glaze 2 is heated at a temperature in the range from the glass softening point to the glass transition point of the glass component contained in the glaze 2. When the glaze 2 is softened, the ends 31A and 31B are sunk into the glaze 2 by their own weight. The amount of sinking can be adjusted by controlling the temperature or time of the heating. Thus, when the upper surfaces of the ends 31A and 31B become flush with the upper surface of the glaze 2, the glaze 2 is caused to recover from the softened state.

Figure 6:
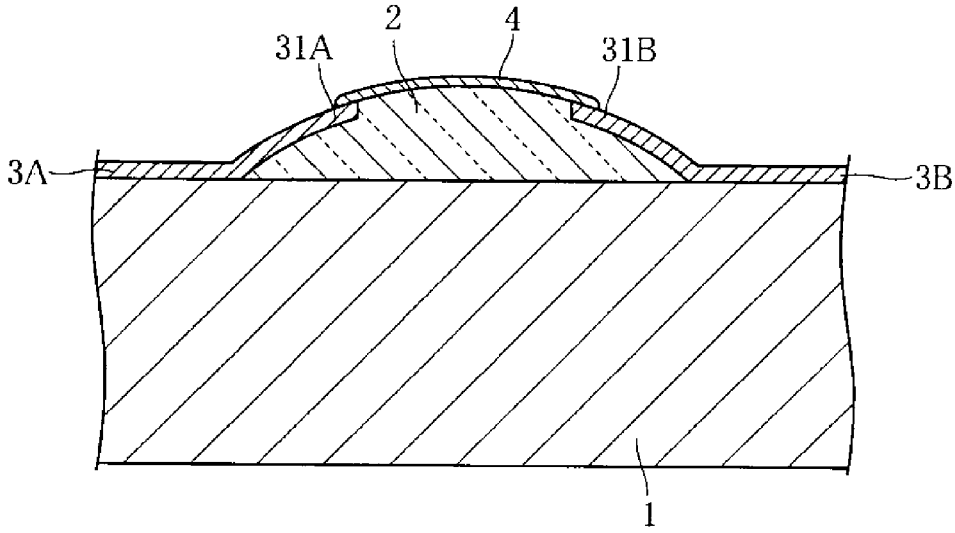
FIG. 6 is a sectional view showing the step of forming an insulating film in the manufacturing method.

Then, as shown in FIG. 6, insulating films 4 are formed. First, to form the insulating films 4, a film of Ta is formed by sputtering to bridge the ends 31A and 31B of each electrode pair 3A and 3B. Then, the Ta film is baked for oxidation. As a result, an insulating film 4 made of $Ta_2O_5$ is obtained. The thickness of the insulating film 4 is set to about 0.1 to 0.2 μm. The insulating film 4 may be made of $SiO_2$ instead of $Ta_2O_5$.

Thereafter, heating resistors 5 covering the insulating films 4 and bridging the electrodes 3A and 3B are made by forming e.g. a $TaSiO_2$ film having a thickness of about 0.05 μm and then subjecting the film to dry etching. Thereafter, by sputtering using e.g. SiC or SiAlON, a protective film 6 is formed to cover the electrodes 3A, 3B and the heating resistors 5. Thus, the thermal printhead A1 as shown in FIGS. 1 and 2 is obtained.

The advantages of the thermal printhead A1 will be described below.

According to the foregoing embodiment, a stepped portion is not provided between each of the electrodes 3A, 3B and the glaze 2. Further, owing to the existence of the insulating films 4, the heating portions 5*a* are positioned close to a recording medium. As a result, the portions of the protective film 6 which cover the heating portions 5*a* are pressed against a recording medium with a high pressure. Thus, the printing speed of the thermal printhead A1 can be increased.

Further, the heat from the heating portions 5*a* is transferred to the glaze 2 via the insulating films 4. Thus, the degree of increase or decrease of the heat the glaze 2 receives can be smaller. As a result, the thermal stress generated in the glaze 2 reduces, whereby the glaze 2 is prevented from cracking. Further, the insulating films 4 function as a mechanical buffer between the glaze 2 and the heating resistors 5. Thus, the thermal expansion or contraction of the glaze 2 (which has a relatively low hardness) is prevented from being suppressed or promoted by the heating resistors 5 (which have a relatively high hardness). This is suitable for preventing the glaze 2 from cracking.

To make the insulating films 4 have a hardness of a level between the hardness of the glaze 2 and that of the heating resistors 5 and a thermal conductivity of a level between the thermal conductivity of the glaze 2 and that of the heating resistors 5, it is preferable to form the insulating films 4 using $Ta_2O_5$. In this embodiment, the region of the glaze 2 which is located between the electrodes 3A and 3B is entirely covered with the insulating film 4. With this structure, the heating resistor 5 and the glaze 2 do not come into contact with each other, which is advantageous for preventing the glaze 2 from cracking.

Figure 7:
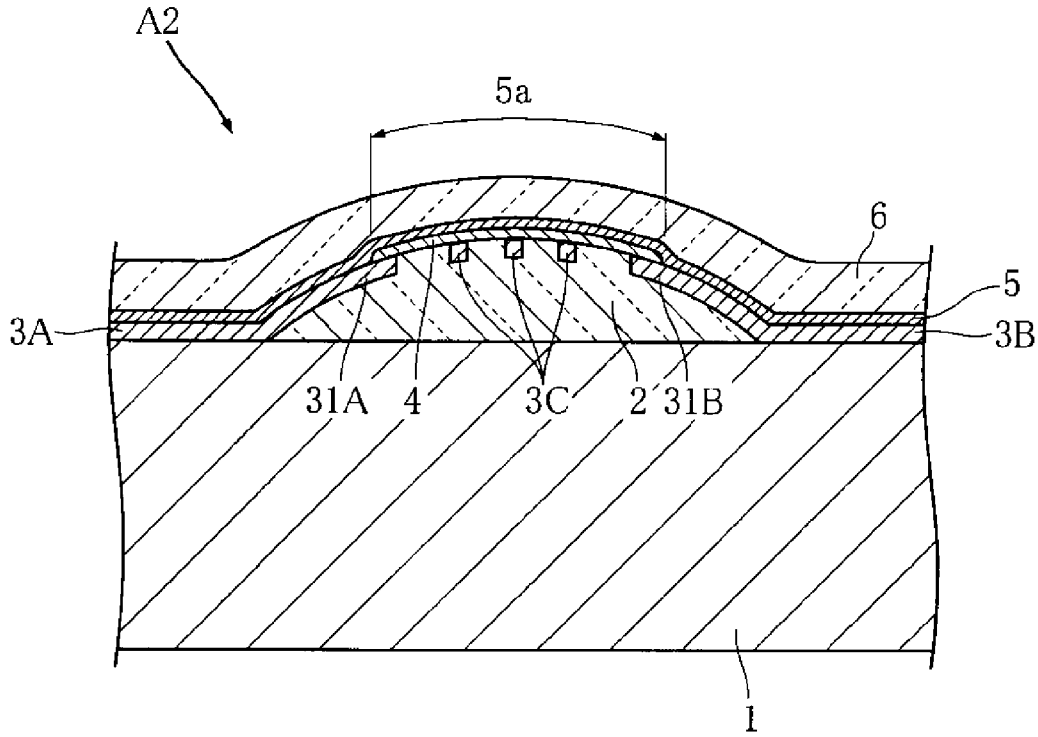
FIG. 7 is a sectional view showing a principal portion of a thermal printhead according to a second embodiment of the present invention.
Figure 8:
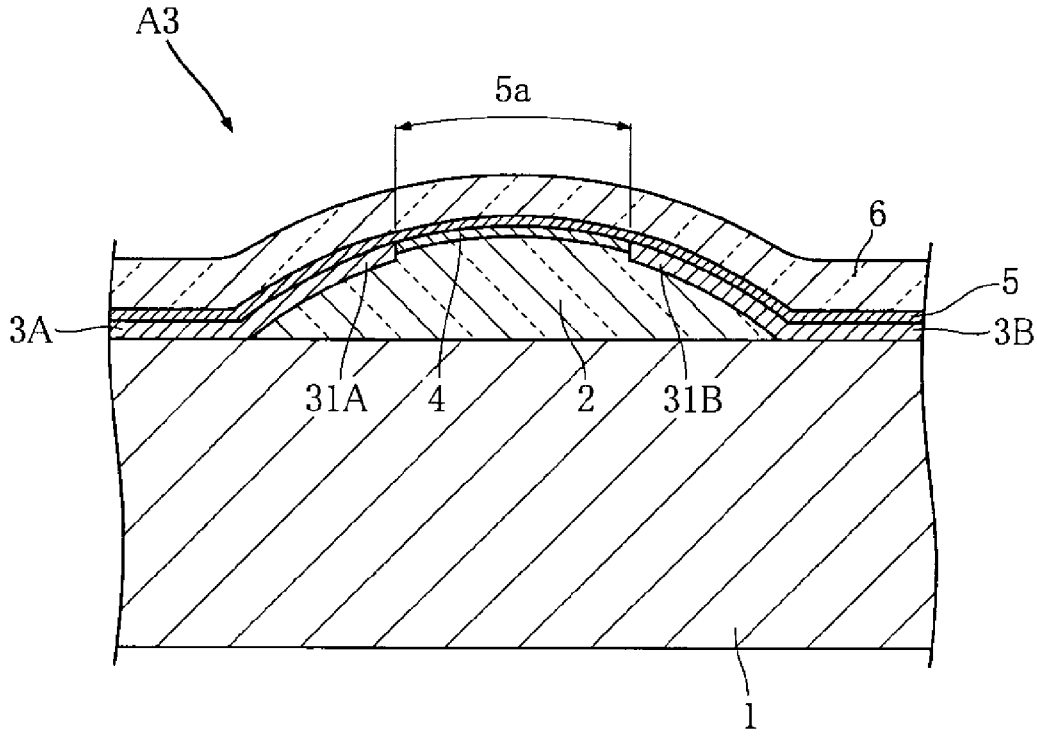
FIG. 8 is a sectional view showing a principal portion of a thermal printhead according to a third embodiment of the present invention.
Figure 9:
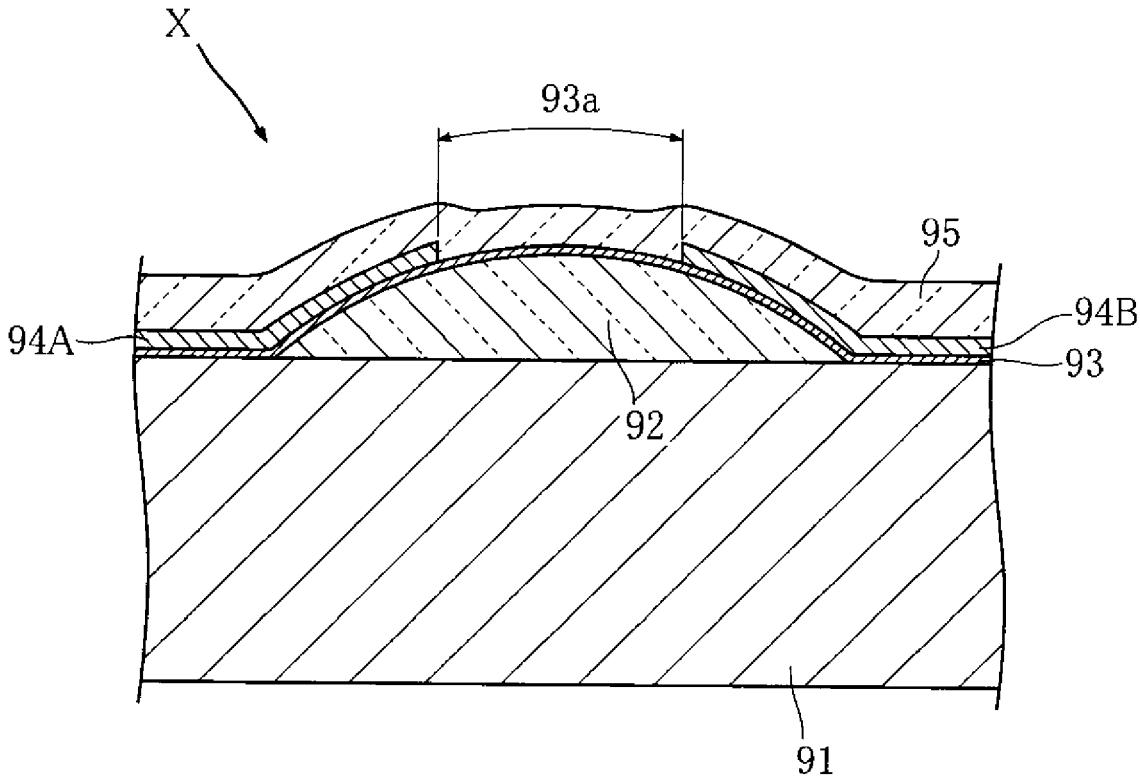
FIG.9 PRIOR ART
FIG. 9 is a sectional view showing a principal portion of an example of conventional thermal printhead.

FIGS. 7 and 8 show other embodiments of the present invention. In these figures, the elements which are identical or similar to those of the first embodiment are designated by the same reference signs as those used for the first embodiment.

FIG. 7 shows a thermal printhead according to a second embodiment of the present invention. Unlike the first embodiment, the illustrated thermal printhead A2 includes a dummy pattern 3C. The dummy pattern 3C is made of e.g. Au and has a relatively high thermal conductivity. The dummy pattern 3C comprises a plurality of elements spaced from each other in the secondary scanning direction. The dummy pattern 3C is formed along with the electrodes 3A and 3B by thick-film printing and baking. Similarly to the electrodes 3A and 3B, the dummy pattern 3C is embedded in the glaze 2 and flush with the glaze 2.

With this arrangement, the heat from the heating portions 5*a* is transferred well to the glaze 2 via the dummy pattern 3C. As a result, the variation in amount of heat transferred from the heating portions 5*a* to a recording medium is alleviated. When the amount of heat applied to the thermal paper varies largely, sticking of the thermal paper to the protective film 6 is liable to occur. According to this embodiment, such sticking phenomenon is prevented.

FIG. 8 shows a thermal printhead according to a third embodiment of the present invention. The illustrated thermal printhead A3 differs from the foregoing two embodiments in positional relationship among the glaze 2, the electrodes 3A, 3B and the insulating films 4. In this embodiment, although the ends 31A and 31B of the electrodes 3A and 3B are sunk in the glaze 2, the amount of sinking is smaller than the thickness of the ends 31A and 31B. Thus, a level difference exists between each of the ends 31A, 31B and the glaze 2. The level difference is substantially equal to the thickness of the insulating film 4. The insulating film 4 is located only between the electrodes 3A and 3B, and does not extend onto the electrodes 3A and 3B.

According to this embodiment, a level difference is hardly defined between each of the electrodes 3A, 3B and the insulating film 4. Thus, the heating resistor 5 is formed on a relatively smooth surface. By forming the heating resistor 5 on a smooth surface free from a level difference, the heating resistor 5 is prevented from having a non-uniform thickness and breaking due to e.g. the pressure applied in the printing process.

The invention claimed is:

1. A thermal printhead comprising:

a substrate;

a glaze formed on the substrate and elongated in a primary scanning direction;

a first and a second electrodes overlapping the glaze and spaced from each other in a secondary scanning direction;

a heating resistor overlapping the first and the second electrodes and including a heat generating portion spaced apart from the electrodes; and an insulating film intervening between at least part of the heating portion of the heating resistor and the glaze;

wherein at least an end of each of the electrodes is embedded in the glaze; and wherein the insulating film has a hardness which is higher than a hardness of the glaze and lower than a hardness of the heating resistor and a thermal conductivity which is higher than a thermal conductivity of the glaze and lower than a thermal conductivity of the heating resistor.

2. The thermal printhead according to claim 1, wherein the insulating film bridges the first and the second electrodes.

3. The thermal printhead according to claim 1, wherein the insulating film is made of either one of $Ta_2O_5$ and $SiO_2$.

4. A method for manufacturing a thermal printhead, the method comprising:

forming a glaze elongated in a primary scanning direction on a substrate and forming a first and a second electrodes spaced from each other in a secondary scanning direction on the glaze;

sinking at least an end of each of the electrodes into the glaze by softening at least part of the glaze by heating;

forming an insulating film to cover at least part of a region of the glaze which is sandwiched between the first and the second electrodes; and forming a heating resistor to overlap the glaze and the first and the second electrodes in such a manner as to bridge the first and the second electrodes;

wherein the insulating film is formed to have a hardness which is higher than a hardness of the glaze and lower than a hardness of the heating resistor and a thermal conductivity which is higher than a thermal conductivity of the glaze and lower than a thermal conductivity of the heating resistor.

* * * * *